United States Patent [19]

Birkle et al.

[11] 4,382,844

[45] May 10, 1983

[54] METHOD FOR HEATING ALUMINUM BATHS

[75] Inventors: Siegfried Birkle, Hoechstadt; Klaus Stoeger, Nuremberg, both of Fed. Rep. of Germany

[73] Assignee: Siemens Aktiengesellschaft, Berlin & Munich, Fed. Rep. of Germany

[21] Appl. No.: 410,520

[22] Filed: Aug. 23, 1982

[30] Foreign Application Priority Data

Sep. 24, 1981 [DE] Fed. Rep. of Germany ..... 3138072

[51] Int. Cl.[3] ..... C25D 17/06; C25D 17/18

[52] U.S. Cl. ..... 204/14 N; 204/237; 204/241; 204/274; 204/DIG. 9

[58] Field of Search ..... 204/14 N, 237, 241, 204/274, DIG. 9

[56] References Cited

U.S. PATENT DOCUMENTS 4,053,383 10/1977 Dötzer et al. ..... 204/225
4,066,515 1/1978 Stoger et al. ..... 204/14 N
4,176,034 11/1979 Stoger et al. ..... 204/200

*Primary Examiner*—John F. Niebling
*Attorney, Agent, or Firm*—Hill, Van Santen, Steadman, Chiara & Simpson

[57] ABSTRACT

Aluminum electroplating installations containing aprotic electrolyte bath systems typically require an electrolyte operating temperature of over 80° C. in order to achieve useable aluminum precipitations. The warming-up and heating of such aluminum electrolyte baths has heretofore been accomplished with indirect heating methods, such as surrounding the baths with a heating jacket or by conducting electrolyte out of the bath through a heat exchanger and then returning the heated electrolyte. The present invention concerns a more efficient heating method whereby Joule's heat is used to heat an aprotic electrolyte bath. Accordingly, at least two electrodes are immersed into the electrolyte and charged with alternating pulses by a square wave pulse generator such that a heating current flows through the electrolyte. The anodes and cathodes of the aluminization electrolyte bath are preferably used as the heating electrodes.

6 Claims, No Drawings

METHOD FOR HEATING ALUMINUM BATHS

BACKGROUND OF THE INVENTION

The invention relates to a method for heating an aluminum electroplating bath of aprotic electrolyte solvent to a prescribed working temperature and keeping the working temperature constant during the aluminum electroplating process.

In installations for the electrodepositing or electroplating of aluminum, there is provided an electroplating tank or trough which contains a heated aprotic, aluminum-organic electrolyte kept under oxygen-free and water-free conditions. The electrolyte must be heated to an operating temperature of over 80° C. in order to promote useful and substantially economic aluminum precipitations on pieces to be plated. The warming and continued heating of such electrolyte presents difficulties since aluminum electrolytic baths can react with the oxygen and the moisture of air causing a considerable reduction in the conductivity and life of the electrolyte and, furthermore, are also highly flammable. Accordingly, direct heating of the electrolyte is not practical, but rather is conventionally undertaken by indirect heating.

Typically, aluminization electrolyte is heated in the electroplating tank by means of an oil jacket which surrounds the tank and in which suitable heating elements are situated. This arrangement is shown, for example, in U.S. Pat. Nos. 4,053,383 and 4,176,034 and the German Offenlegungsschrift No. 2537285. It is also known to heat aluminization electrolyte by a continuous pumping of electrolyte out of the electroplating tank through a heat exchanger and then back into the tank. These known arrangements for heating aluminization electrolyte, however, have drawbacks in that there may be relatively high thermal losses, higher manufacturing costs such as for thermal installation and when a heating jacket or pipe lines and pumps are required, and they necessitate a suitably complicated and expensive temperature control mechanism.

The present invention is directed to a simplified method for heating an aluminum electroplating bath of aprotic electrolyte which requires little outlay and can be easily set to practically any prescribed working temperature.

SUMMARY OF THE INVENTION

The aprotic electrolyte contained in an aluminum electroplating tank is heated in situ within the tank by means of an electrical current flow providing a Joule's heat effect. Accordingly, at least two electrodes are disposed directly within the electrolyte and charged with a pulse current of alternating polarity, whereby the clock ratio, the amplitude and/or the frequency of the alternating pulses are preferably continuously variable. In accordance with the present invention, the anodes and cathodes used in the aluminum electroplating process may themselves be employed as the heating electrodes.

DESCRIPTION OF THE PREFERRED EMBODIMENT

The present invention concerns heating of an aprotic electrolyte solvent contained in an aluminum electroplating tank, including warm-up to a suitable operating temperature and continued maintenance of a working bath temperature, by generating Joule's heat in the tank.

Joule's heat is evolved when electrical current flows through a medium having electrical resistance, as given by Joule's Law. Aprotic electrolyte baths have relatively low electrical conductivity and, thus, exhibit high resistance which facilitates the heating.

The Joule's heat is generated in the electrolyte contained in the electroplating tank by providing at least two electrodes disposed in the tank and charged with a pulse-type electric current of alternating polarity. The clock ratio, the amplitudes, and/or the frequency of the alternating pulses are preferably continuously variable. In accordance with the invention, the anodes and cathodes used in the aluminum electroplating process and disposed in the electrolyte bath are employed as the electrodes. An alternating voltage with a specific frequency and variable, different cathodic ($t_1$) and anodic ($t_2$) pulse times (the clock ratio being $t_1$:$t_2$) as well as a corresponding amplitude level is applied between the electrodes, such that a specific, predetermined amount of Joule's heat is produced due to the occurring current flux.

It is known to use square wave pulse generators to charge the anodes and cathodes in an aluminization electrolyte bath for the aluminum electroplating process. Such a square wave pulse generator, already employed in an aluminum electroplating installation, may also be used to generate the alternating voltage through the heating electrodes, here the aluminization bath anodes and cathodes, to produce the Joule heat. Accordingly, the pulse generator for the aluminum electroplating installation performs two tasks in accordance with the present invention, namely the reduction of aluminum cations to metal and the maintenance of the electrolyte temperature at a suitably heated level.

Further, in accordance with the present invention, the cooler surfaces mounted over the electroplating tank, such as the conventional hood or cover, serve to condense electrolyte solvent vapors arising from the bath. Condensed vapors collecting on these condensation surfaces drop back into the electrolyte bath and, in this manner, cooperate with the Joule heating system to control or maintain the temperature of the electrolyte bath by virtue of an equilibrium heating and cooling effect.

The Joule heating system can be set to keep the electrolyte temperature constant, i.e., leveling the temperature over time deviation to zero. A negative deviation in temperature, i.e., cooling, can be represented as a function of the amplitude level and of the clock ratio of the alternating current. A positive deviation of temperature, i.e., excess heating, may result during the precipitation of aluminum on the piece being plated in the form of condensation heat dissipated in the electrolyte. In an aprotic electrolyte system, heat resulting from the precipitation of aluminum on the piece being plated naturally arises in that approximately one-half of the organic solvents in the electrolyte precipitate. In order to control the electrolyte temperature, control of the individual current pulses from the pulse generator is carried out such that the mean cathodic current density remains below the current density limit of the electrolyte permitting electroplating. The setting of the current clock ratio in the range of 1:1 through 10:1, which is particularly favorable for aluminum electroplating action, is inversely proportional to the temperature fluctuation $\Delta T$ of the electrolyte. Accordingly, the clock ratio must become smaller given an increasing temperature fluctuation ΔT during the warming-up phase of the heating process and approach the valve 1 to produce large temperature increases. In accordance with the present invention, the clock ratio, amplitude and/or the frequency of the alternating current pulses are variable to control heating.

For example, in order to bring the electrolyte in an aluminum electroplating installation from room temperature to, for example, 100° C., the following values are set at the pulse generator:

| | |
|---|---|
| frequency = | 10,000 Hz, |
| clock ratio = | 1:1 (arithmetic mean of the current |
| = | 0; no aluminum precipitation), |
| cathodic current density = | 3 A/dm 2, and |
| voltage = | 10–50 V. |

The following values are set at the pulse generator in order to provide simultaneous control of the electrolyte temperature and afford precipitation of aluminum in the electroplating process:

| |
|---|
| frequency = 10–100 Hz, |
| clock ratio is variable from 1:1 through 10:1, and |
| cathodic current density is 0.5 through 3 A/dm 2. |

The inventive electrolyte heating control mechanism functions with cells having a low coating power. In such cases, the generated and emitted heat is approximately the same.

With respect to cells having a high coating power, the majority of the generated current heat is dissipated over evaporating solvent which condenses at the cooler surfaces of the tank hood and returns into the electrolyte bath.

Although various minor modifications may be suggested by those versed in the art, it should be understood that we wish to embody within the scope of the patent warranted hereon all such modifications as reasonably and properly come within the scope of our contribution to the art.

We claim as our invention:

1. A method of heating an aprotic electrolyte bath contained in a tank for an aluminum electroplating system having anode and cathode elements in contact with said bath to a predetermined working temperature and for maintaining said temperature constant during the aluminization process comprising generating Joule's heat in said bath by immersing at least two electrodes in the electrolyte bath and charging said electrodes with pulse currents of alternating polarity and controlling the bath temperature by varying the clock ratio, amplitude, and/or frequency of the alternating current pulses.

2. The method of claim 1, further comprising using a square wave generator to generate the pulse currents and charge said cathode and anode elements.

3. The method of claim 2, wherein said electrodes are said anode and cathode elements.

4. The method of claim 3, further comprising providing condensation surfaces over said tank for condensing vapors rising from said electrolyte bath into condensate and from which the condensate returns back into the bath, said returning condensate cooperating in controlling the bath temperature.

5. The method of claim 1, wherein said electrodes are said anode and cathode elements.

6. The method of claim 1, further comprising providing condensation surfaces over said tank for condensing vapors rising from said electrolyte bath into condensate and from which the condensate returns back into the bath, said returning condensate cooperating in controlling the bath temperature.

* * * * *